US006082051A

United States Patent [19]

Burton et al.

[11] Patent Number: 6,082,051

[45] Date of Patent: Jul. 4, 2000

[54] FOLDING STAGE

[75] Inventors: David J. Burton, Woodbury; Gary W. Andert, Rosemount, both of Minn.

[73] Assignee: Sico Incorporated, Edina, Minn.

[21] Appl. No.: 09/121,375

[22] Filed: Jul. 23, 1998

[51] Int. Cl.[7] ..... B66C 23/06; E04F 11/00

[52] U.S. Cl. ..... 52/7; 52/118; 52/182; 108/169; 108/173; 108/174

[58] Field of Search ..... 52/6, 7, 8, 9, 117, 52/118, 182, 183; 108/168, 169, 173, 174, 176, 177, 144.11

[56] References Cited

U.S. PATENT DOCUMENTS

| | | | |
|---|---|---|---|
| 3,245,363 | 4/1966 | Amthor, Jr. et al. | 108/168 X |
| 3,495,370 | 2/1970 | Habro et al. | 52/118 |
| 4,054,096 | 10/1977 | Wilson et al. | 108/169 |
| 4,949,649 | 8/1990 | Terres et al. . | |
| 5,392,718 | 2/1995 | Stevens | 52/7 X |
| 5,515,654 | 5/1996 | Anderson | 52/118 |
| 5,613,450 | 3/1997 | Wagner et al. | 52/7 X |

FOREIGN PATENT DOCUMENTS

| | | |
|---|---|---|
| WO 93/03240 | 2/1993 | WIPO . |
| WO 98/59134 | 12/1998 | WIPO . |

*Primary Examiner*—Richard Chilcot
*Attorney, Agent, or Firm*—Merchant & Gould P.C.

[57] ABSTRACT

An elevationally adjustable folding stage (20) includes stages decks (22) on a folding frame (24). Telescoping legs (26) extend from the frame (24) and include a spacer assembly (80). A spacer member (84) is engaged by a spreader member (82) to adjust the width of the spacer assembly (80). Rotatable wheels (88) are mounted on the spacer member (84) to engage the inner portion of an outer leg member of the telescoping legs (26). A spacing linkage (30) includes linkage members (52) and (54) with a stop member (58) mounted on the first linkage member (52) and engaging the top of the second spacing linkage (54). Stop member (58) is adjustably mounted to change the engagement point and the folding range of the folding linkage (28) and therefore, the alignment of the stage (20).

10 Claims, 9 Drawing Sheets

FOLDING STAGE

BACKGROUND

1. Field of the Invention

The present invention is directed to a folding stage and in particular, to an elevationally adjustable mobile folding stage with improved folding and stability.

2. Prior Art

Folding stages are used for a variety of purposes to provide a temporary raised platform for use in schools, hotels, convention centers and other institutions or multiple use facilities requiring the capability of setting up temporary stages. Such stages may be positioned adjacent one another to form an extended stage surface or positioned to support bridging decks between the stages to form an extended stage surface. When not in use, the stages have a framework that folds to compact dimensions for storage. The stages typically have two stage decks hinged together along a center line to provide folding action and have legs that remain substantially vertical when the stage decks fold. An example of such a folding stage is shown in U.S. Pat. No. 5,325,640 to Luedke et al., issued Jul. 5, 1994, assigned to Sico, Incorporated, the Assignee of the present invention. Although the Luedke et al. patent is very successful in providing useful and efficient folding stages, further improvements are still possible, particularly with regard to stages that fold from the use position to a storage position, with the underside of the stages substantially opposing one another in the folded storage position.

To provide elevationally adjustable stages, the legs of the stage framework must be able to telescope to adjust the height of the stage decks. As the elevational adjustment increases, the distance that the inner leg must nest into the outer leg increases. As the distance increases, the likelihood that the legs will bind or loosen, especially with use over time, increases. Therefore, it is necessary to provide spacing that provides a sturdy leg structure with little freedom between the telescoping leg members to eliminate wobble. At the same time, it is important that the spacer assembly provide for the telescoping leg members to slide easily relative to one another.

A common problem with folding stages that increases over time is the adjustment of the stage to ensure that the decks remain substantially aligned and horizontal in the unfolded use position. Prior stages, as shown in U.S. Pat. No. 5,325,640 to Luedke et al., utilize a bolt in the center joint area of the stage. The bolt acts as a step where the two deck frameworks come together along the folding line. Adjustment of the stop adjusts the relative position of the frame and the decks. These types of stages use a spacing linkage to apply tension on the stage folding linkage and take up any looseness that would allow the stage to rock or shift. As this linkage passes through a toggle position to a locked position, the decks are folded to a slightly concave alignment before they revert back to level. At this point, the leveling bolt acts as a spring with an extremely high spring constant that must be compressed before it can return to the level position. Although this configuration does provide alignment, it does not provide much compression, forcing other portions of the linkage to have some looseness in order to allow the linkage to pass through the toggle position. Over time, the components may wear, changing alignment so that the bracing of the framework is less rigid and has more play. This condition results in a stage feeling less solid in the unfolded use position.

It can be seen then that a new and improved stage is required that overcomes the problems of the prior art. The spacer assembly for the telescoping legs should provide a snug fit that does not loosen or bind over time and that provides for easy sliding and adjustment of the telescoping legs. An improved stage should provide a locking and spacing mechanism that can be easily adjustable and that does not cause other components to loosen and lead to wobbling and a less sturdy stage. The present invention addresses these as well as other problems associated with elevationally adjustable folding stages.

SUMMARY

The present invention is directed to improvements in folding stages, and in particular to improvements in elevationally adjustable folding stages.

Folding stages fold from a use position to a storage position with a pair of stage decks forming a planar stage surface in the use position. In the folded storage position, the undersides of the stage decks substantially oppose one another. The stage has a folding framework with a plurality of telescoping supporting legs. The framework generally folds along a center line under the convergence of the two stage decks. The framework has a folding linkage that facilitates folding between the storage and use positions. In addition, a spacing linkage acts as a lock to maintain the stage in the unfolded use position, as well as to provide spacing and alignment of the stage decks. The spacing linkage has opposed links pivotally connected and extending between opposed telescoping legs. A spacer member is slidably mounted on a first link and includes a tab extending over above the second link that engages the top of the second link after the linkage passes through a toggle point. The framework includes a spring at the center intermediate the frame members at the center folding axis of the stage. As the spacer member is adjustably mounted, it can change the stop point along the folding range of the spacing linkage. The stop position affects the pivoting range of the stage's folding linkage, and therefore the alignment of the stage in the unfolded position. The spacing linkage may also include a handle extending outward therefrom to ease folding and unfolding.

The elevationally adjustable folding stage includes telescoping leg members that slide relative to one another to change the height of the stage surface. The telescoping leg members include an inner leg member sliding within an outer leg member and telescoping outward therefrom. A spacer assembly mounts on the upper end of the inner telescoping leg member and engages an inner surface of the outer telescoping leg member. The spacing assembly includes a spacer member having a wheel mounted at each end thereof, extending diagonally across the inner portion of the outer leg member and engaging the inner corners of the outer leg member. The wheels rotate as the inner leg slides relative to the outer leg. The spacer member has a spreader member mounted proximate thereto that pushes the spacer member outward as the spreader member is pushed downward against the spacer member. In this manner, tension and spacing may be adjusted to ensure proper fit between the spacer assembly and the outer telescoping leg member.

These features of novelty and various other advantages which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

Referring now to the drawings, wherein like reference numerals and letters indicated corresponding structure throughout the several views.

DETAILED DESCRIPTION OF THE PREFERRED EMBODIMENT

Figure 1:
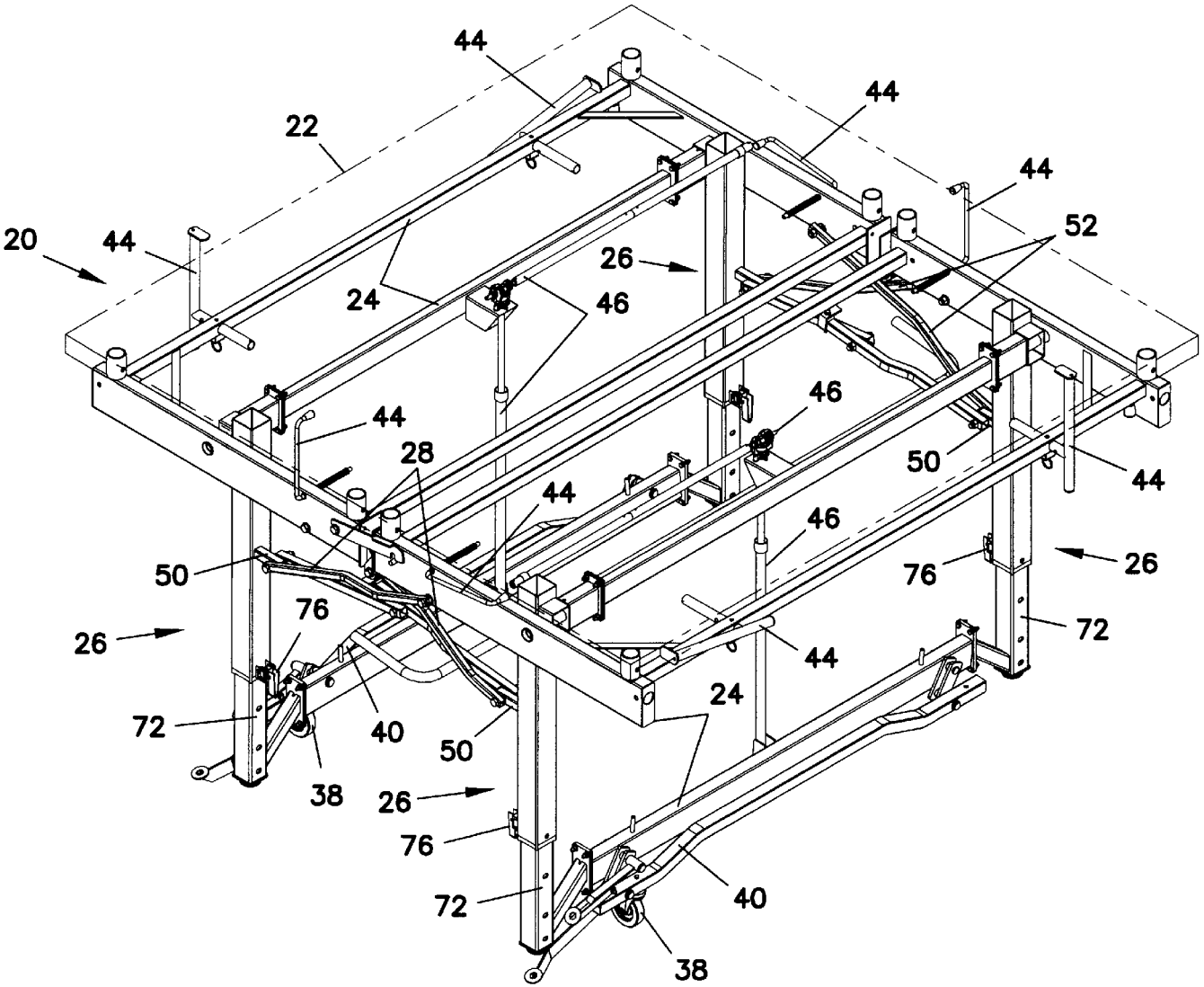
FIG. 1 shows a perspective view of an elevationally adjustable folding stage according to the principles of the present invention.

Referring now to the drawings, and in particular to FIGS. 1–5, there is shown an elevationally adjustable folding stage, generally designated 20. The stages 20 folds between an unfolded use position, shown in FIGS. 1, 4 and 5, and a folded storage position, shown in FIG. 2. In the use position, a pair of stage decks 22 form a substantially planar upper stage surface. Each of the decks 22 is supported on a frame 24 and telescoping legs 26. A folding linkage 28 facilitates movement between the folded and unfolded positions.

A stage 20 may include casters or rollers 38 that are mounted between the legs 26 and pivot on a linkage 40 between a raised and lowered position to facilitate movement of the stage 20 when not in use. The stage 20 may also include deck retainers 44 for retaining bridging panels extending between stages to form an extended stage. A power lift mechanism 46 may adapt to a drill or other power input for raising and lowering the height of the stage 20. To facilitate folding, the stage 20 may include torsion bars or springs approximately aligned with the center of gravity for the framework 24 to ease folding and unfolding.

The folding linkage 28 includes mounting members 50 extending from each of the legs 28. The folding linkage 28 extends upward to engage the frame 24 below the stage decks 22. It can be appreciated that alignment of the stage decks 22 relative to one another to ensure a level stage surface requires careful alignment of the supporting frameworks 24. To ensure this with proper and easy folding, alignment devices may be required. As shown most clearly in FIG. 2, the present invention includes a spring 34 extending between center frame member surfaces 32 above center pivot members 42. A lock 36 extends between the frames 24 to prevent the stage 20 from unfolding from the use position when engaged.

Figure 6:
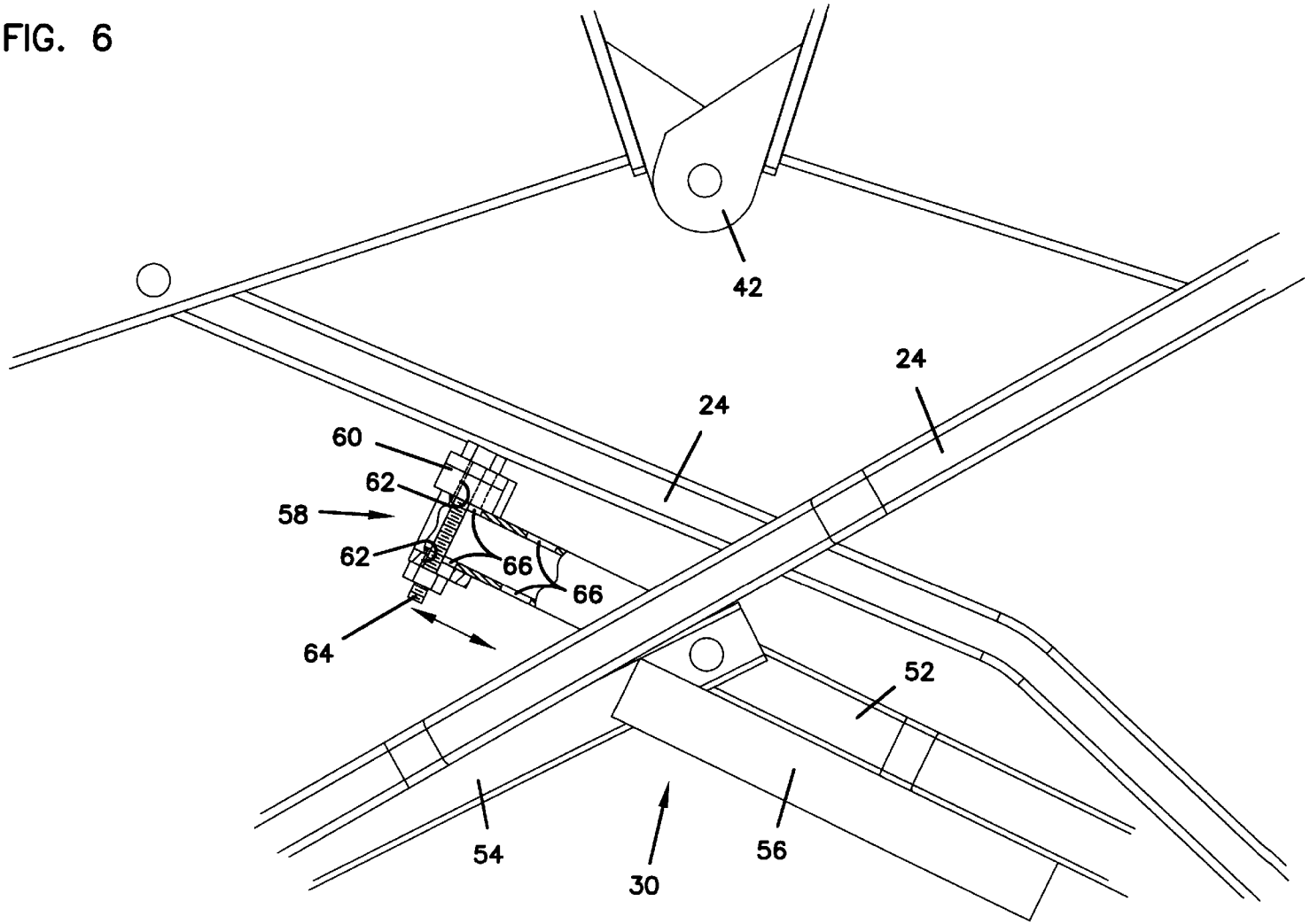
FIG. 6 shows a detail view of the stop member of the spacing linkage for the folding stage shown in FIG. 1.

According to the present invention, a spacing linkage or lock 30 also mounts to and extends between the mounting members 50. Spacing linkage 30 also prevents unfolding and provides adjustment of the folding range of stage 20 to align the decks 22. The spacing linkage 30 includes first and second linkage members 52 and 54 and an adjustable stop member 58 mounted on the linkage member 52 and engaging the top of the second linkage member 54 with a tab 60. The stop member 58 includes a slot 62 with a retainer 64, such as a bolt with an associated nut, extending through the slot 62 and an orifice 66 formed through the first linkage member 52, to retain the stop member 58 at a desired position along the slot 62, as shown in FIG. 6. The slot may also be formed in the first linkage member 52 so that the stop member 58 and the retainer 64 slide along the first linkage member 52. The stop member 58 is moved by loosening the retainer 64, sliding the slotted stop member 58 along the retainer 64 to the desired position and tightening the retainer. The first linkage member 52 may include a plurality of orifices 66 for mounting the stop member spaced at intervals to provide greater adjustment range for positioning the stop member 58. A handle 56 extends from the spacing linkage 30 to aid in locking and unlocking the spacing linkage 30. The handle 56 extends laterally outside of the second linkage member 54 to provide easy and safe access for an operator.

Figure 2:
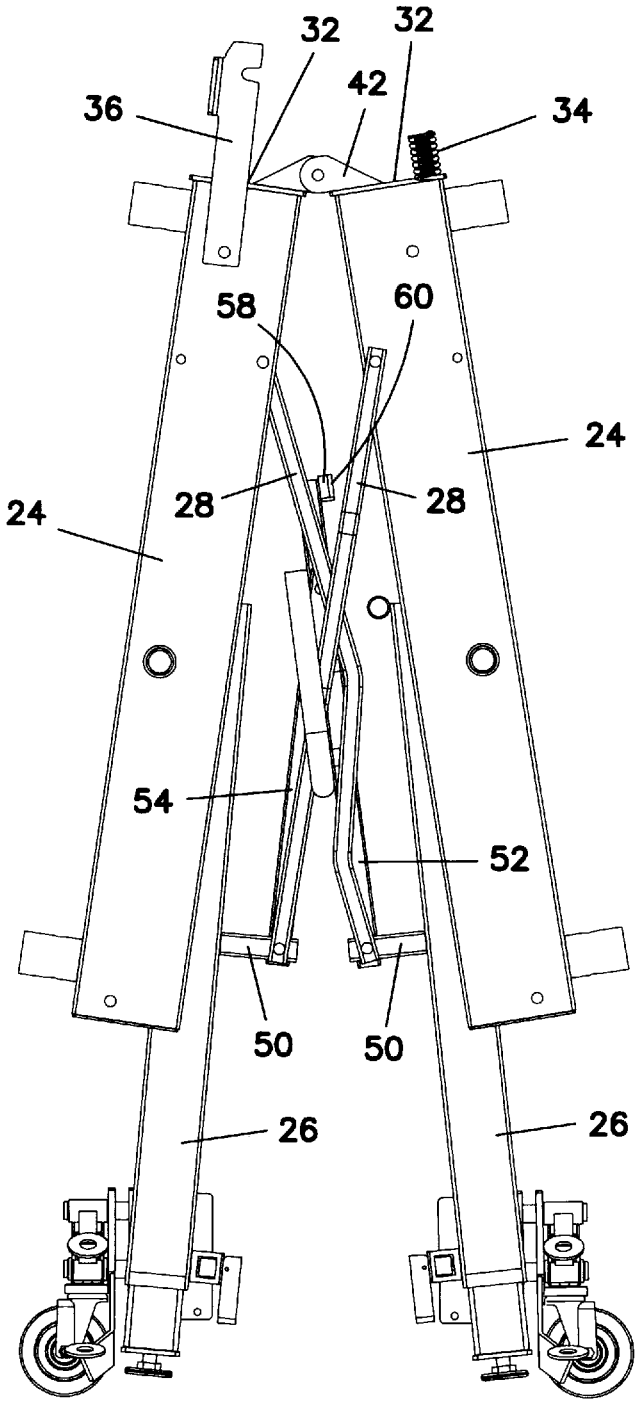
FIG. 2 shows a side elevational view of the stage shown in FIG. 1 in a folded storage position.
Figure 3:
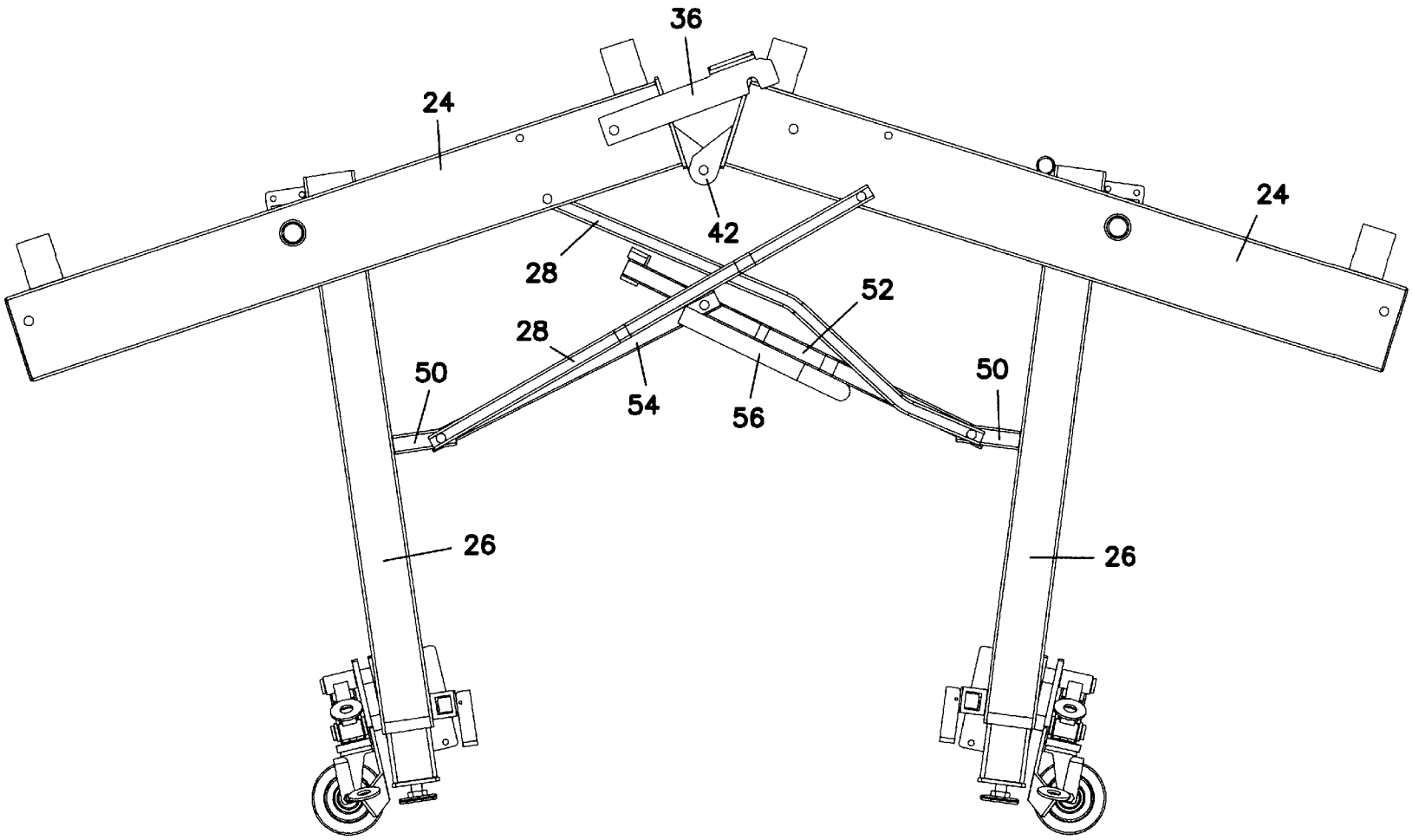
FIG. 3 shows a side elevational view of the stage shown in FIG. 1 in a partially folded position.
Figure 4:
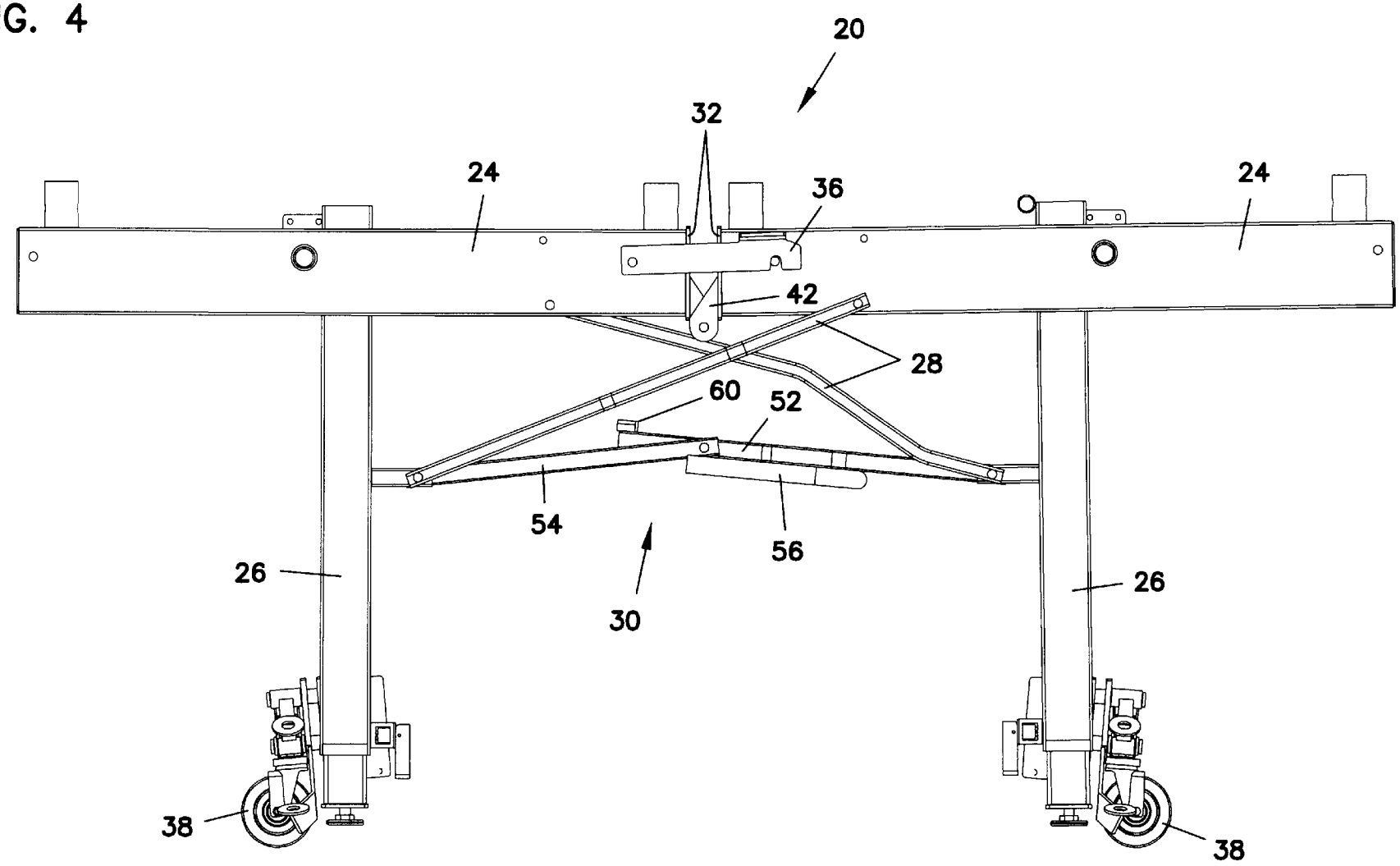
FIG. 4 shows a side elevational view of the stage shown in FIG. 1 in an unfolded position.
Figure 5:
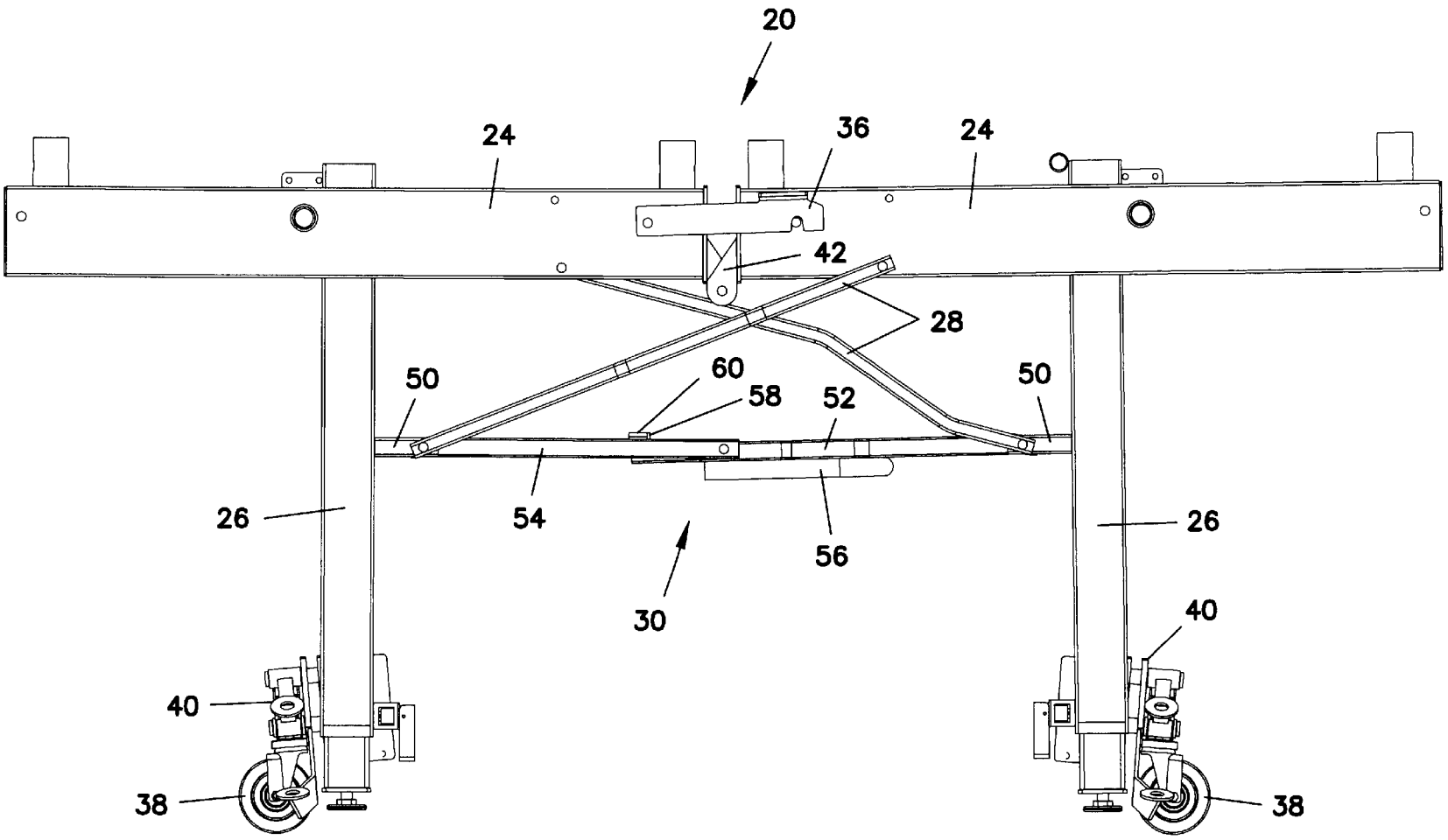
FIG. 5 shows a side elevational view of the stage shown in FIG. 1 in an unfolded position with the spacer linkage locked.

In operation, as the stage 20 is folded from the storage position, as shown in FIG. 2, to the unfolded position, as shown in FIGS. 4 and 5, the stage 20 approaches the unfolded position and the spring 34 engages the opposed center frame member surface 32. The spacing linkage 30 is very nearly horizontal, as shown in FIG. 4. However, it will be necessary to pass the spacing linkage 30 through a toggle position. Once the linkage members 52 and 54 pass beyond the toggle position, as shown in FIG. 5, and actually extend slightly below horizontal, the spacing linkage 30 is stopped from further pivoting by the stop member 58 engaging the top of the second linkage member 54. In this manner, the spacing linkage 30 "snaps" into a locked position acting as a lock against folding. To fold the stage 20, the handle 56 is lifted to pull the spacing linkage 30 back through the toggle point, aided by the biasing force of the center spring 34 acting to fold the stage 20.

By moving the stop member 58 along the first linkage member 52, the point of engagement between the stop member 58 and the second linkage member 54 shown in FIG. 5 can be varied, as illustrated in phantom in FIG. 6. Changing the position of the tab 60 changes the geometry of the locked position of the linkage 30. Moving the final position of the spacing linkage 30 changes the unfolded position of the frame 24. Therefore, to make adjustments in the position of the frame 24 at the unfolded use position, the stop member 58 may be moved longitudinally along the slot 62 and locked in position with the retainer 64. The spacing linkage 30 provides for an easy and effective method of adjusting and aligning the stage 20.

Figure 7:
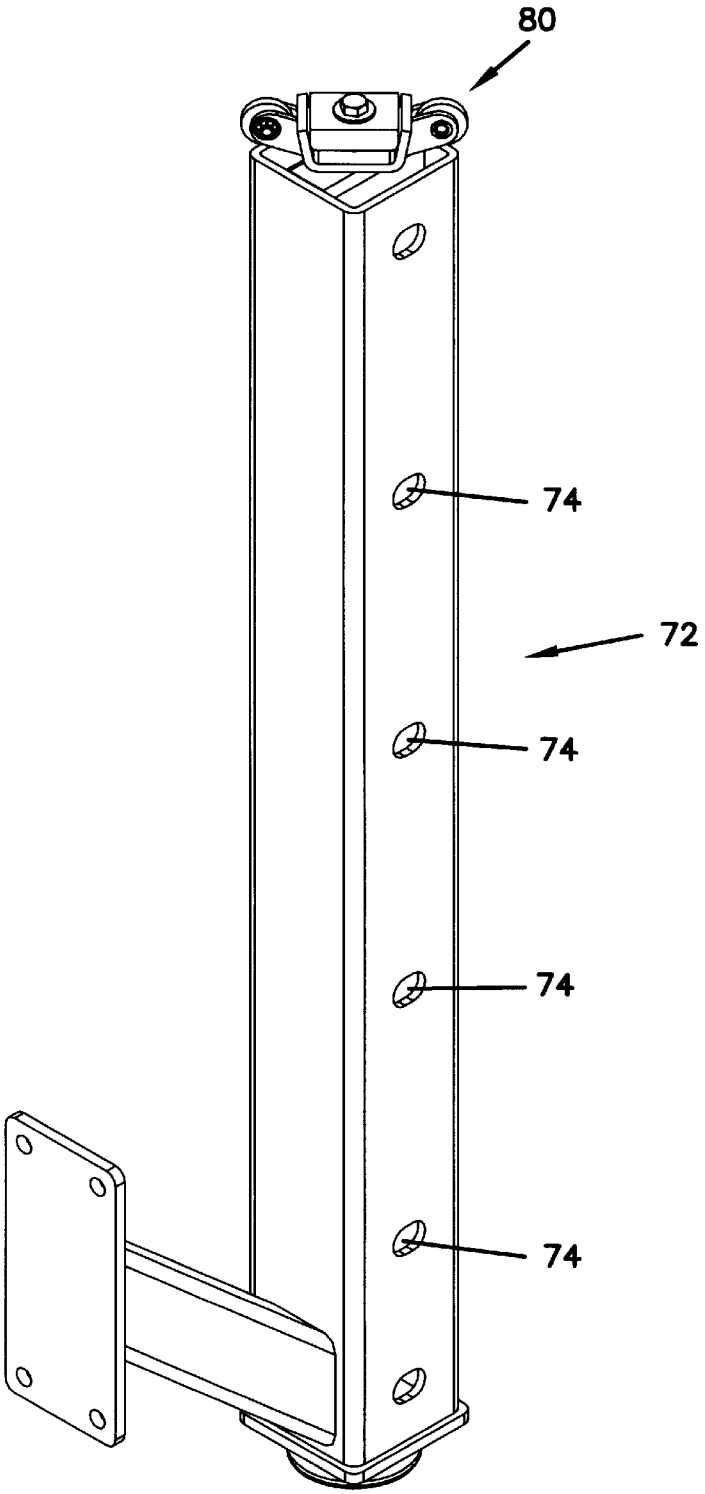
FIG. 7 shows a perspective view of an inner telescoping leg member and spacer assembly for the stage shown in FIG. 1.
Figure 8:
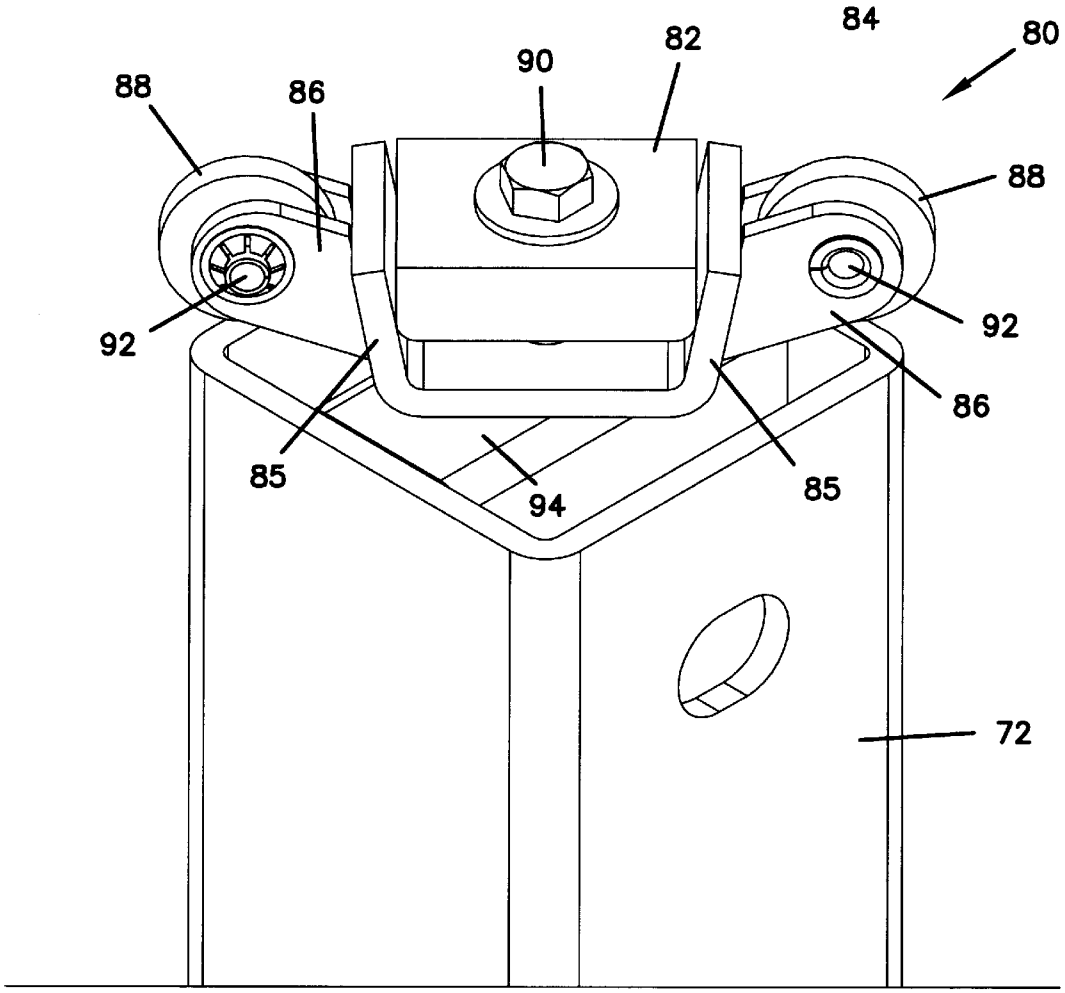
FIG. 8 shows a perspective view of the top of an inner leg member of a telescoping leg shown in FIG. 7; and, FIG. 9 shows a top plan view of the spacer assembly and a telescoping leg.
Figure 9:
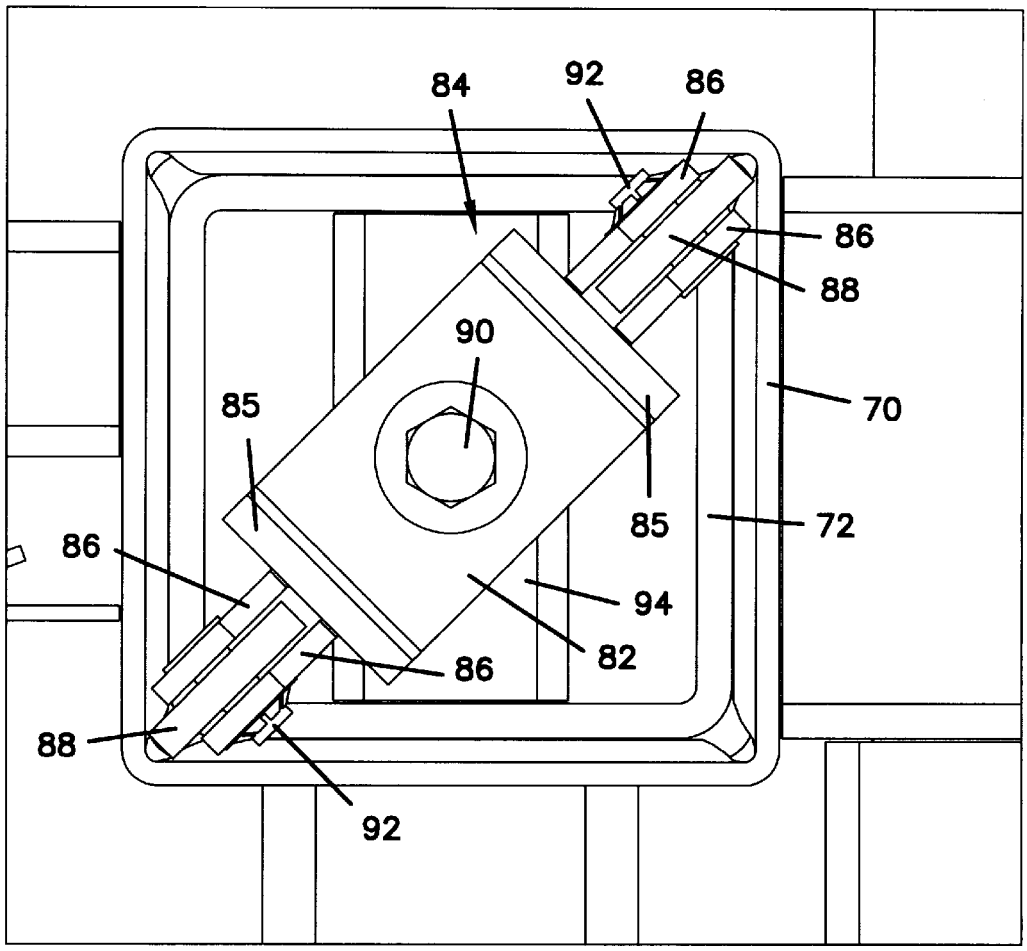

Referring now to FIGS. 7–9, the telescoping legs 28 of present invention include a spacer assembly 80. As shown in FIGS. 1–5, each of the telescoping legs 28 includes an outer leg member 70 above an inner telescoping leg member 72. The inner telescoping leg member 72 can be raised and lowered within the outer leg member 70 to provide elevational adjustment of the stage 20 by actuating the power lift mechanism 46. The outer leg member 70 includes a spring loaded adjustment pin 76 that engages spaced apart height adjustment holes 74 in the inner telescoping leg member 72. With this configuration, the stage 20 can be raised and lowered and retained at varying predetermined heights, typically having intervals at six or eight inches. For easy adjustment, the telescoping leg members 70 and 72 must slide easily relative to one another yet not bind or have too much play to cause instability in the stage 20. The bottom of each of the outer leg members 70 may be pinched inward to closely engage the rectangular periphery of the inner telescoping leg member 72. The spacer assembly 80 mounts to the top of the inner telescoping leg member 72 on a mounting bar 94 extending between opposed sides of the inner telescoping leg member 72.

As shown in FIG. 8, the spacer assembly 80 extends diagonally engaging opposite inner corners of the rectangular outer leg member 70. The spacer assembly 80 includes a spreader member 82 engaging a somewhat U-shaped spacer member 84. A bolt 90 includes a washer and threadably mounts into the mounting bar 94. The spreader member 82 is located above the spacer member 84. The spacer member 84 includes a base with slightly diverging portions 85 extending upward around the ends of the spreader member 82. As the bolt 90 is tightened downward, the spreader member 82 is pushed further down the slightly diverging portions 85 of the spacer member 84, pushing the slightly diverging portions 85 outward. Downward movement of the spreader member 82 increases the width of the spacer assembly 80. The spacer member 84 includes end sections 86 attached to and extending laterally outward of the slightly diverging portions 85 and angling upward and supporting wheels 88 on axles 92. The wheels 88 engage the comers of the inner wall of the outer leg member 70 and rotate as the leg members 70 and 72 are raised and lowered relative to one another to facilitate easier sliding. The end sections 86 extend upward and the axles 92 are located above the attachment of the end sections 86 to the slightly diverging portions 85. By having the wheels 88 mounted above attachment of the end sections 86 to the slightly diverging portions 85, over-tightening of the bolt 90 drives the wheels 88 downward and outward until increasing pressure from the wheels 88 engaging the walls of the outer leg member 70 creates a braking effect. In a similar manner, if the wheels 88 encounter an obstruction within the outer leg member 70, continued relative vertical movement between the outer leg member 70 and inner leg member 72 causes the wheels 88 to apply increased pressure to the inner walls of the outer leg member 70, creating a braking effect. This braking effect will stall the lift mechanism 46 without damage to the spacer assembly 80.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A telescoping leg having a substantially rectangular cross-section, comprising:

a first leg member;

a second leg member telescoping relative to the first member, and inserting at least partially into the first leg member;

a spacer mounted to the second leg member and extending diagonally across the rectangular cross-section of the first leg member; the spacer including a pair of wheels;

including a first wheel engaging a first corner of the first leg member and a second wheel engaging a second diagonally opposite corner of the first leg member.

2. A leg according to claim 1, wherein the spacer includes a mounting member having a first angled end portion supporting the first wheel and a second angled end section supporting the second wheel.

3. A leg according to claim 2, wherein the mounting member includes a substantially u-shaped portion with first and second end sections extending from opposite sides of the u-shaped portion.

4. A leg according to claim 3, wherein the wheels mount laterally outward beyond and above an attachment point of the end sections to the u-shaped portion.

5. A leg according to claim 3, wherein the angled end portions extend upward and outward.

6. An elevationally adjustable stage having a telescoping leg with a substantially rectangular cross-section, comprising:

a first leg member;

a second leg member telescoping relative to the first member, and inserting at least partially into the first leg member;

a spacer mounted to the second leg member and extending diagonally across the rectangular cross-section of the first leg member; the spacer having a pair of wheels, including a first wheel engaging a first corner of the first leg member and a second wheel engaging a second diagonally opposite corner of the first leg member.

7. A stage according to claim 6, wherein the spacer includes a mounting member having a first angled end portion supporting the first wheel and a second angled end section supporting the second wheel.

8. A stage according to claim 7, wherein the mounting member includes a substantially u-shaped portion with first and second end sections extending from opposite sides of the u-shaped portion.

9. A stage according to claim 8, wherein the wheels mount laterally outward beyond and above an attachment point of the end sections to the u-shaped portion.

10. A stage according to claim 9, wherein the angled end portions extend upward and outward.

* * * * *